United States Patent [19]

Sakamoto et al.

[11] Patent Number: 4,746,328

[45] Date of Patent: May 24, 1988

[54] STABILIZED FUEL OIL CONTAINING A DISPERSANT

[75] Inventors: Naoyuki Sakamoto; Hirokazu Kawashimo, both of Yokohama; Koji Kishimoto, Wakayama; Takayuki Ikenaga, Wakayama; Yoshihide Watanabe, Wakayama; Shigemi Hayashi, Wakayama, all of Japan

[73] Assignees: Kao Corporation; Karonite Chemical Co., Ltd., both of Tokyo, Japan

[21] Appl. No.: 886,822

[22] Filed: Jul. 18, 1986

[30] Foreign Application Priority Data

| | | | |
|---|---|---|---|
| Jul. 19, 1985 | [JP] | Japan | 60-159559 |
| Sep. 30, 1985 | [JP] | Japan | 60-217525 |
| Sep. 30, 1985 | [JP] | Japan | 60-217526 |
| Apr. 23, 1986 | [JP] | Japan | 61-94075 |

[51] Int. Cl.[4] ..... C10L 1/18; C10L 1/22; C10L 1/24; C10L 1/26

[52] U.S. Cl. ..... 44/72; 44/63; 44/71; 44/76

[58] Field of Search ..... 44/63, 71, 72, 76

[56] References Cited

U.S. PATENT DOCUMENTS

| | | | |
|---|---|---|---|
| 3,012,964 | 12/1961 | Pollitzer | 44/72 |
| 3,457,053 | 7/1969 | Rosenwald | 44/72 |
| 3,542,679 | 11/1970 | Cyba | 44/71 |
| 3,637,358 | 1/1972 | Cyba | 44/72 |
| 3,804,605 | 4/1974 | Robinson et al. | 44/63 |
| 4,292,046 | 9/1981 | Piotrowski | 44/63 |
| 4,518,782 | 5/1985 | Sung et al. | 44/63 |
| 4,581,039 | 4/1986 | Horodysky | 44/71 |

*Primary Examiner*—William R. Dixon, Jr.
*Assistant Examiner*—Jerry D. Johnson
*Attorney, Agent, or Firm*—Birch, Stewart, Kolasch & Birch

[57] ABSTRACT

A residual fuel oil is improved in dispersion stability when a large amount of sludge is contained therein and comprises (1) a thermal cracking oil, (2) a diluent and (3) a dispersant selected from the group consisting of (A) an imidazoline derivative containing a hydrocarbon group having 7 to 23 carbon atoms, (B) a hydrolysis product of (A), (C) a reaction product of an aliphatic acid having 8 to 22 carbon atoms and a polyalkylene-polyamine having 4 to 6 amino groups, (D) a monoamine containing a hydrocarbon group having 8 to 22 carbon atoms, (E) a polyamine containing a hydrocarbon group having 8 to 22 carbon atoms, (F) an etheramine having a long chain hydrocarbon group, (G) a phosphate having a long chain hydrocarbon group, (H) a salt of (G), (I) a dithiophosphate and (J) a salt of (I).

19 Claims, No Drawings

STABILIZED FUEL OIL CONTAINING A DISPERSANT

The present invention relates to a stable residual fuel oil comprising a thermal cracking residual oil of a heavy oil as a base and a dispersant additive for imparting stability. It provides a dispersant for residual fuel oil.

STATEMENT OF PRIOR ARTS

A straight run residual oil and a desulfurization residual oil have up to now been used as a residual fuel oil. With a recent increase of heaviness in crude oils and an increase of lightness required for petroleum products, a thermal cracking residual oil from a visbreaker or the like has been used. By visbreaking, the aromatic component content is reduced, the resin component content is reduced and contents of the saturated component and asphaltene component are increased. The stability is, however, degraded. For example the storage stability, thermal stability and mixing stability are degraded, and many problems are caused by a formed asphaltene sludge. For example, accumulation of the sludge in the bottom of a fuel tank, occurrence of a hindrance in a cleaner and clogging of a strainer, can be mentioned.

The mechanism of formation of the asphaltene sludge will now be described. In case of a fuel oil having a good stability, asphaltene is dispersed in an oil while forming a micelle. In this case, the aromatic characteristic of the dispersion medium is important, and if the aromatic characteristic is insufficient, aggregation of asphaltene is caused to form a sludge. It is known that a highly aromatic fuel oil base is used to prevent formation of a sludge according to the above-mentioned mechanism. It has now been confirmed that stabilization can be attained by the use of a specific dispersant additive.

As a conventional sludge dispersant, there can be mentioned metal salts of sulfonic acid and naphthenic acid, surface active agents such as higher fatty acid esters and methacrylates, and polymeric compounds. However, they do not exert any effect to thermal cracking residual fuel oils. Some of metal type detergent dispersants, for example, alkaline earth metal salts of alkyl salicylates used for lubricating oils, show an excellent effect, but there is a risk of occurrence of a problem because of adhesion of an ash component to an injection nozzle.

SUMMARY OF THE INVENTION

In order to overcome the above discussed problems, the invention provides a residual fuel oil comprising (1) a thermal cracking oil, (2) a diluent and (3) a dispersant selected from the group consisting of (A) an imidazoline derivative containing a hydrocarbon group having 7 to 23 carbon atoms, (B) a hydrolysis product of (A), (C) a reaction product of an aliphatic acid having 8 to 22 carbon atoms and a polyalkylenepolyamine having 4 to 6 amino groups, (D) a monoamine containing a hydrocarbon group having 8 to 22 carbon atoms, (E) a polyamine containing a hydrocarbon group having 8 to 22 carbon atoms, (F) an etheramine having a long chain hydrocarbon group, (G) a phosphate having a long chain hydrocarbon group, (H) a salt of (G), (I) a dithiophosphate and (J) a salt of (I).

In the invention, the residual fuel oil comprises the oil, an effective amount of an diluent and an effective amount of the dispersant. It preferably comprises 15 to 79.95 wt.% of (1) the thermal cracking oil, 20 to 80 wt.% of (2) the diluent and 0.05 to 5 wt.% of (3) the dispersant.

The additive for a residual fuel oil according to the present invention, can disperse asphaltene and the like contained in a thermal cracking residual oil in a good condition and formation of a sludge can be prevented. Accordingly, if a residual fuel oil containing the additive of the present invention is used, various problems caused by formation of sludges can be avoided.

The invention includes one preferable embodiment in which dispersant (3) is selected from the group consisting of (A), (B), (C), (D) and (E) and some preferable embodiments comprising a dispersant (F), (G), (H), (I) and (J), respectively.

The invention will be illustrated in detail with reference to each embodiment.

Embodiment (A) through (E)

We have conducted a research with a view toward solving these problems and providing an ash-free fuel oil additive in which asphaltene can be stably dispersed and no ash is produced. As a result, it has been found that if a specific compound selected from the group consisting of imidazoline derivatives, hydrolysis products of imidazoline derivatives, reaction products of long-chain fatty acids with polyalkylenepolyamines and amine compounds is added to a residual fuel oil, the above object can be attained.

More specifically, in accordance with the present invention, there is provided a residual fuel oil comprising a thermal cracking residual oil, a diluent and a dispersant additive, wherein the dispersant additive is selected from the group consisting of imidazoline derivatives having a hydrocarbon residue having 7 to 23 carbon atoms, hydrolysis products thereof, reaction products of fatty acids having 8 to 22 carbon atoms with polyalkylenepolyamines having 4 to 6 amino groups and monoamines and polyamines having a hydrocarbon residue having 8 to 22 carbon atoms.

The dispersant to be used in the preferred embodiment is defined below. Dispersant (A) has the formula (A-1). (B) has the formula of (B-1) or (B-2). (C) has the formula (C-1), (C-2) or (C-3). (D) has the formula (D-1). (E) has the formula (E-1).

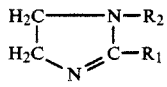

(A-1)

wherein $R_1$ stands for a hydrocarbon group having 7 to 23 carbon atoms, and $R_2$ stands for a hydrogen atom or a substituent selected from the group consisting of hydrocarbon groups having 1 to 22 carbon atoms and aminoalkyl, acylaminoalkyl and hydroxyalkyl groups having 2 to 44 carbon atoms.

$$R_1CONH(CH_2)_2NHR_2 \quad \text{(B-1)}$$

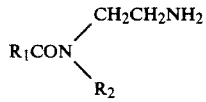

(B-2)

wherein $R_1$ stands for a hydrocarbon group having 7 to 23 carbon atoms, and $R_2$ stands for a hydrogen atom or a substituent selected from the group consisting of hydrocarbon groups having 1 to 22 carbon atoms and aminoalkyl, acylaminoalkyl and hydroxyalkyl groups having 2 to 44 carbon atoms.

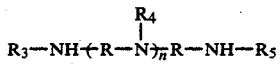

(C-1)

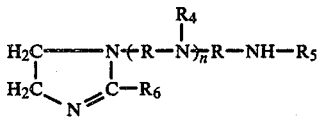

(C-2)

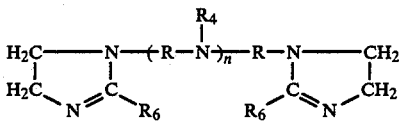

(C-3)

wherein $R_3$ and $R_4$ stand for each a hydrogen atom or an acyl group having 8 to 22 carbon atoms, $R_5$ stands for an acyl group having 8 to 22 carbon atoms, $R_6$ stands for a hydrocarbon group having 7 to 23 carbon atoms, R stands for an alkylene group having 2 to 4 carbon atoms, and n is an integer of from 1 to 4.

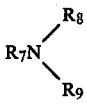

(D-1)

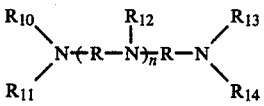

(E-1)

wherein $R_7$ stands for a hydrocarbon group having 9 to 22 carbon atoms, $R_8$ and $R_9$ stand for each a hydrogen atom or a hydrocarbon group having 8 to 22 carbon atoms, $R_{10}$, $R_{11}$, $R_{12}$, $R_{13}$ and $R_{14}$ stand for each a hydrogen atom or a hydrocarbon group having 8 to 22 carbon atoms and at least one of $R_{10}$ through $R_{14}$ has an alkylene group, R stands for an alkylene group having 2 to 4 carbon atoms, and n is an integer of 0 to 9.

In stable residual fuel oils customarily used, the dry sludge content is lower than 0.1% by weight as determined according to the Shell hot filtration test. If this value exceeds 0.1% by weight, a sludge is readily formed and the oil becomes unstable.

The residual fuel oil of the present invention is formed by adding a specific dispersant additive to a thermal cracking oil, which is a residual oil obtained through a thermal cracking treatment, such as visbreaking of a heavy oil and a diluent. Even if an unstable base which has a dry sludge content exceeding 0.1% by weight, as determined according to the above-mentioned method, in the absence of using a dispersant additive, the dry sludge content in the residual fuel oil formed by the addition of the dispersant additives is reduced below 0.1% by weight, and the residual fuel oil is very stable and formation of a sludge is prominently controlled.

It is preferred that the dispersant additive be added to the thermal cracking residual oil before incorporation of the diluent or be added to a mixture of the thermal cracking residual oil and the diluent. Furthermore, the dispersant additive may be added to the diluent before being incorporated into the thermal cracking residual oil.

As the diluent, there are suitably used in the present invention cracked cycle oil, kerosene and gas oil. The content of the diluent in the residual fuel oil can be changed in a broad range, but the content is ordinarily 20 to 80% by weight.

As preferred examples of the imidazoline derivative having a hydrocarbon residue having 7 to 23 carbon atoms, used in the present invention, there can be mentioned 2-alkylimidazolines and imidazoline derivatives having a substituent having 1 to 44 carbom atoms. A long-chain alkyl (or long-chain alkenyl) imidazoline is generally synthesized by dehydration condensation of a corresponding long-chain fatty acid, for example, oleic acid with a polyamine. The formed imidazoline is ordinarily called "oleylimidazoline", and in this case, the term "oleyl" indicates R of oleic acid ($RCO_2H$). Accordingly, this expression is similarly adopted in the present invention. As the alkyl group of the 2-alkylimidazoline, there can be mentioned undecyl, heptadecyl, oleyl, lauryl and erucyl. As the substituent of the substituted imidazoline derivative, there can be mentioned hydroxyalkyl groups, aminoalkyl groups, acylaminoalkyl groups and hydrocarbon groups having 1 to 22 carbon atoms. As the hydroxyalkyl-substituted imidazoline derivative, there can be mentioned 2-oleyl-1-hydroxyethylimidazoline and 2-erucyl-1-hydroxyethylimidazoline, and as the aminoalkyl-substituted imidazoline derivative, there can be mentioned 2-oleyl-1-aminoethylimidazoline and 2-oleyl-1-aminoethylaminoethylimidazoline. As the acylaminoalkyl-substituted imidazoline derivative, there can be mentioned 2-oleyl-1-oleoloylaminoethylimidazoline and 2-stearyl-1-stearoylaminoethylimidazoline. Among them, there are preferably used substituted imidazoline derivatives such as 2-oleyl-1-hydroxyethylimidazoline, 2-oleyl-1-aminoethylimidazoline and 2-oleyl-1-oleoloylaminoethylimidazoline.

The hydrolysis product of the imidazoline derivative can be obtained by hydrolyzing an imidazoline derivative as mentioned above with water or an aqueous alkaline solution. There can be mentioned oleoloylethylenediamine, N-hydroxyethyloleoloylethylenediamine and N-aminoethyloleolylethylenediamine.

Various reaction products of the fatty acid having 8 to 22 carbon atoms with the polyalkylenepolyamine having 4 to 6 amino groups are obtained according to the molar ratio between the two reactants and the reaction conditions. For example, monoamidopolyamines, polyamidopolyamines, monoamidomonoimidazolines, monoamidopolyimidazolines, polyamidomonoimidazolines and polyamidopolyimidazolines can be mentioned. Ordinarily, the reaction product is obtained in the form of a mixture of an amidopolyamine and an amidoimidazoline. In the present invention, however, a single component may also be used.

As specific examples, there can be mentioned a mixture of 2-oleyl-1-aminoethyloleoloylaminoethyloleoloylaminoethylimidazoline and N-oleoloylaminoethyloleoloylaminoethyloleoloylaminoethylethylenediamine, obtained by reaction of 3 moles of oleic acid with 1 mole of tetraethylenepentamine, and a mixture of 2-lauryl-1-aminoethyllauroylaminoethylimidazoline and N-lauroylaminoethyllauroylaminoethylethylenediamine, obtained by reaction of 2 moles of lauric acid with 1 mole of triethylenetetramine. It is preferred that the mixture be composed mainly of an imidazoline ring-containing compound.

As the monoamine or polyamine containing a hydrocarbon group having 8 to 22 carbon atoms, used in the present invention, there can be mentioned monoamines such as oleylamine, hardened beef tallow amine and distearylamine, and polyamines such as N-oleylpropylenediamine, N-(hardened beef talloy alkyl)-propylenediamine, N-(hardened beef tallow alkyl)dipropylenetriamine and N-(hardened beef tallow alkyl)-tripropylenetetramine. Among them, N-oleylpropylenediamine, N-(hardened beef tallow alkyl)dipropylenetriamine and N-(beef tallow alkyl)tripropylenetetramine are preferred.

The dispersant is used in an amount shown before. It is used practically at 0.1 to 5.0 wt.%, preferably 0.25 to 0.5 wt.%.

EMBODIMENT (F)

We have made a research with a view toward solving the foregoing problems, and have found that if an ether amine or ether polyamine having a long-chain alkyl group is added to a residual fuel oil, the above problems can be solved. We have now completed the present invention based on this finding.

The dispersant (F) preferably has the formula (F-1):

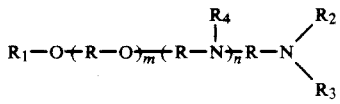

(F-1)

wherein $R_1$ stands for a hydrocarbon group having 8 to 36 carbon atoms, $R_2$, $R_3$ and $R_4$ stand for each a hydrogen atom or a hydrocarbon group having 8 to 22 carbon atoms, R stands for an alkylene group having 2 to 4 carbon atoms, n is an integer of 0 to 9, and m is an integer of 0 to 15.

Moreover, in accordance with the present invention, there is provided a residual fuel oil comprising a thermal cracking oil, a diluent and a dispersant additive, wherein the dispersant additive is a compound preferably having the formula (F-1).

Any of the compounds represented by the general formula (F-1) can be used as the additive for a residual fuel oil in the present invention. For example, there can be mentioned compounds represented by the following formula:

$$R_1—O—CH_2CH_2CH_2NH_2$$

wherein $R_1$ stands for a dodecyl, tridecyl, stearyl or oleyl group, compounds represented by the following formulae:

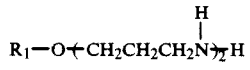

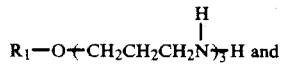

and

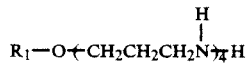

wherein $R_1$ stands for a dodecyl, tridecyl, stearyl or oleyl group, and compounds represented by the following formula:

$$R_1(CH_2CH_2O)_nCH_2CH_2CH_2NH_2$$

wherein $R_1$ stands for a dodecyl, tridecyl, stearyl or oleyl group.

The foregoing compounds used as the additive for a residual fuel oil in the present invention may be prepared, for example, by reacting an alcohol $R_1OH$ with acrylonitrile and hydrogenating the reaction product, or by adding an alkylene oxide to an alcohol $R_1OH$, reacting the resulting addust with acrylonitrile and hydrogenating the reaction product. As the alcohol $R_1OH$, there may be used saturated, unsaturated, linear, branched, Guerbet and synthetic alcohols.

The amount of the additive used of the present invention may be appropriately determined according to the properties of the residual fuel oil. However, it is preferred that the amount of the added additive be 0.05 to 5.0% by weight, especially 0.1 to 1.0% by weight.

Embodiment (G) and (H)

We have conducted research with a view toward solving the foregoing problems, and have found that if a phosphoric ester having a long-chain alkyl group is added to a residual fuel oil, the above problems can be solved. We have now completed the present invention based on this finding.

More specifically, in accordance with the present invention, there is provided an additive for a residual fuel oil, which comprises a compound (G) having the formula (G-1) or a salt thereof (H):

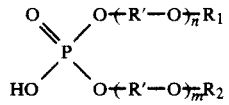

(G-1)

wherein $R_1$ stands for a hydrogen atom or a hydrocarbon group having 8 to 30 carbon atoms, $R_2$ stands for a hydrogen atom or a hydrocarbon group having 8 to 30 carbon atoms, R' stands for an alkylene group having 2 to 4 carbon atoms, and n and m are integers of 0 to 15, with the proviso that the case where both of $R_1$ and $R_2$ simultaneously stand for a hydrogen atom is excluded.

Moreover, in accordance with the present invention, there is provided a residual fuel oil comprising a thermal cracking oil, a diluent and a dispersant additive, wherein the dispersant additive is a compound represented by the above-mentioned general formula (G-1).

A compound having formula (G-1) can be used in the invention. As the additive, for example, there can be mentioned octyl phosphate, dodecyl phosphate, stearyl phosphate, behenyl phosphate, dioctyl phosphate, didodecyl phosphate, distearyl phosphate, dibehenyl phosphate, salts thereof, and phosphates of alkylene oxide adducts of alcohols having 8 to 30 carbon atoms.

The above-mentioned compounds used as additives for residual oils in the present invention can be easily derived from alcohols $R_1OH$. As the alcohol $R_1OH$, there may be used saturated, unsaturated, linear, branched, Guerbet and synthetic alcohols.

An amount of the additive to be used in the present invention may be appropriately determined according to the properties of the residual fuel oil. However, it is preferred that the amount of the added additive be 0.05 to 5.0% by weight, especially 0.1 to 1.0% by weight.

Embodiment (I) and (J)

In order to solve the above-described problems, the inventors have made a large number of intensive studies. As a result, they discovered that the above-described problems can be solved by adding dithiophosphoric acid ester having a long-chain alkyl group to residual fuel oil, and arrive at the present invention.

Namely, the present invention provides additives for residual fuel oil, comprising a compound (I) having the formula (I-1) or a salt thereof (J).

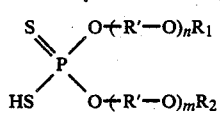

(I-1)

wherein $R_1$ denotes hydrogen or a hydrocarbon group having 8 to 30 carbon atoms, $R_2$ denotes hydrogen or a hydrocarbon group having 8 to 30 carbon atoms, R' denotes an alkylene group having 2 to 4 carbon atoms, n and m are integers of 0 through 15, and $R_1$ and $R_2$ are never simultaneously hydrogen.

The compounds used as the additives for residual fuel oils are any compounds which can be represented by the formula (I-1). The compound (I) preferably includes a dithiophosphate such as octyl dithiophosphate, dodecyl dithiophosphate, stearyl dithiophosphate, behenyl dithiophosphate, dioctyl dithiophosphate, didodecyl dithiophosphate, distearyl dithiophosphate and dibehenyl dithiophosphate, a salt of each above mentioned phosphate and an ester between a dithiophosphoric acid and an alkylene oxide adduct of an alcohol having 8 to 30 carbon atoms or an alkyl phenol. The salts used are alkali metal salts, alkaline earth metal salts, amine salts, zinc salt, etc.

The above-described compounds used as the additives for residual fuel oils can readily be derived from, for example, alcohols in the form of R-OH, alkyl phenol or alkylene oxide adducts thereof according to the following reaction formula:

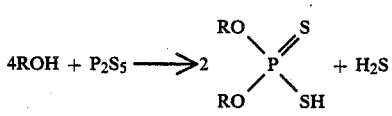

As the alcohols in the form of R-OH can be used saturated alcohols, unsaturated alcohols, straight-chain alcohols, branched-chain alcohols, syhthetic alcohols, etc.

The invention will be illustrated in greater detail with reference to working examples. Examples are below disclosed according to each embodiment shown above.

EMBODIMENTS (A) TO (E)

Examples 1 to 21

In the examples, the residual fuel oils used were residual fuel oils A and B which comprises a visbroken thermal cracking residual oil and a cracked cycle oil, as the diluent. In the case of, residual fuel oil A, the amount of the added diluent was 30% and the viscosity was 220 cSt, and in case of the residual fuel oil B, the amount of the added diluent was 40% and the viscosity was 110 cSt. The dispersant additive was added to the thermal cracking residual oil before addition of the diluent.

The following dispersant additives were used, and they were added in amounts shown in Table 1.

Dispersant additive A:
2-heptadecylimidazoline
Dispersant additive B:
2-oleyl-1-aminoethylimidazoline
Dispersant additive C:
2-oleyl-1-hydroxyethylimidazoline
Dispersant additive D:
2-oleyl-1-oleoloylaminoethylimidazoline
Dispersant additive E:
reaction product of 1 mole of tetraethylenepentamine with 3 moles of oleic acid
Dispersant additive F:
hydrolysis product of the additive C (N-hydroxyethyloleoloylethylenediamine)
Dispersant additive G:
N-oleylpropylenediamine
Dispersant additive H:
N-(hardened beef tallow alkyl)dipropylenetriamine
Dispersant additive I:
N-(beef tallow alkyl)tripropylenetetramine With respect to the residual fuel oils containing the above-mentioned additives, the dry sludge content was measured, the spot test was carried out and the sludge particles were observed with a microscope. The obtained results are shown in Table 1.

The evaluation tests were carried out according to the following methods.

(Measurement of Dry Sludge Content)

The dry sludge content was measured according to the Shell hot filtration test (Journal of the Institute of Petroleum, 37, 333, pages 596–604, September 1951).

(1) A filter paper (Whatman filter paper No. 50, 55 mm in diameter) was dried at 100° C. for 1 hour, accurately weighed and set in a test apparatus.
(2) A heating jacket was attached and steam was circulated in the jacket to effect heating at 100° C.
(3) The sample residual fuel oil (10 g) was heated at 100° C. and poured onto the filter and filtration was carried out under reduction of the pressure by suction and air or nitrogen pressurization.
(4) After completion of the filtration, supply of steam into the jacket was discontinued and cold water was circulated to effect cooling.
(5) After washing with n-heptane, the filter was taken out and dried at 100° C. for 1 hour, and the weight of the filter was measured.
(6) The amount of the dry sludge (% by weight based on the total amount of the sample) collected on the filter paper was determined.

(Spot Test)

The spot test was carried out according to the method disclosed in Nisseki Review, 23, 4, pages 212–213.

(1) The additive was added to the sample residual fuel oil, and the mixture was heated at 100° C. and sufficiently stirred with a stirrer.
(2) The sample was taken out with a glass rod and one drop was dropped on a filter paper (Toyo filter paper No. 50).
(3) The filter paper was allowed to stand at 100° C. for 1 hour, and the state of the spot ring was judged by the 6-staged evaluation method described below according to ASTM D-2781.

The standard of evaluation of the spot ring is as follows.

No. 1:

There is no inner ring and the spot is uniform.

No. 2:

There appears a thin or slight inner ring.

No. 3:

A thin inner ring appears, which is slightly darker than the background.

No. 4:

The thickness of the appearing inner ring is larger than that of the inner ring No. 3, and the inner ring is much darker than the background.

No. 5:

A particulate portion is present at the center of the inner ring and the inner ring is much darker than the background.

No. 6:

The inner ring was formed entirely of particles and the thickness is large.

(Observation with Microscope)

In observation with a microscope, the residual fuel oil used in the above-mentioned spot test was dropped on a slide glass to form a thin layer and the sample was observed according to the transmission method at 300 magnifications.

The results of these tests are shown in Table 1. In each of the residual fuel oils of the present invention, the dry sludge content was lower than 0.1% by weight, and they were stable. In the spot test, in case of the residual fuel oils of the present invention, the evaluation standard No. 1 attained if the concentration of the additive exceeded a certain level, and it was confirmed that a very excellent dispersion stability was attained. It may be thought that by the effect of the dispersant additive, aggregation of asphaltene is prevented and the sludge is finely divided and stably dispersed.

In the microscopic observation, aggregated asphaltene was not detected in any of residual fuel oils 2, 4, 5, 6, 8 through 11, 13 through 17 and 19 through 21. In residual oils 1, 3, 7, 12 and 18, the present of a small amount of aggregated asphaltene was observed. This is in agreement with the dry sludge content and the results of the spot test.

Comparative Examples 1 through 6

Additive-free residual fuel oils and residual fuel oils containing dispersant additives customarily used for lubricating oils were tested in the same manner as in the examples.

The following additives were used.

Additive J:

polyisobutenyl succinate (reaction product between polyisobutenylsuccinic anhydride and pentaerythritol)

Additive K:

polyisobutenylsuccinimide (reaction product between polyisobutenylsuccinic anhydride and tetramethylenepentamine)

The results of the measurement of the dry sludge content and the spot test are shown in Table 1.

In the microscopic observation test, a large amount of aggregated asphaltene was observed in each of the residual fuel oils of Comparative Examples 1 through 6 shown in Table 1.

TABLE 1

| | Residual Fuel Oil | Additive | Concn. (% by weight) of Additive | Dry Sludge Content (% by weight) | Evaluation of Spot Ring |
|---|---|---|---|---|---|
| Example No. | | | | | |
| 1 | A | C | 0.25 | 0.09 | 3 |
| 2 | A | C | 0.5 | 0.04 | 1 |
| 3 | A | E | 0.5 | 0.09 | 3 |
| 4 | A | E | 1.0 | 0.05 | 1 |
| 5 | B | A | 1.0 | 0.05 | 1 |
| 6 | B | B | 1.0 | 0.04 | 1 |
| 7 | B | C | 0.1 | 0.09 | 3 |
| 8 | B | C | 0.25 | 0.05 | 1 |
| 9 | B | C | 0.5 | 0.04 | 1 |
| 10 | B | D | 0.25 | 0.08 | 2 |
| 11 | B | D | 0.5 | 0.06 | 1 |
| 12 | B | E | 0.1 | 0.09 | 3 |
| 13 | B | E | 0.25 | 0.04 | 1 |
| 14 | B | E | 0.5 | 0.03 | 1 |
| 15 | B | F | 0.25 | 0.06 | 1 |
| 16 | B | F | 0.5 | 0.04 | 1 |
| 17 | B | G | 1.0 | 0.06 | 1 |
| 18 | B | H | 0.25 | 0.09 | 3 |
| 19 | B | H | 0.5 | 0.05 | 1 |
| 20 | B | I | 0.25 | 0.06 | 1 |
| 21 | B | I | 0.5 | 0.04 | 1 |
| Comparative Example No. | | | | | |
| 1 | A | — | — | 0.5 | 5 |
| 2 | A | J | 1.0 | 0.5 | 5 |
| 3 | A | K | 1.0 | 0.5 | 5 |
| 4 | B | — | — | 0.2 | 4 |
| 5 | B | J | 1.0 | 0.2 | 4 |
| 6 | B | K | 1.0 | 0.2 | 4 |

Embodiment (F)

This as examined in the same way as shown in Embodiments (A) to (E).

Examples 1 to 13 and Comparative Examples 1 to 6

The following dispersant additives were used, and they were added in amounts shown in Table 2.

(Dispersant Additive)

Dispersant additive A:

$C_{12}H_{25}—O—CH_2CH_2O)_5CH_2CH_2CH_2NH_2$

Dispersant additive B:

$$C_{12}H_{25}—O\left(CH_2CH_2CH_2\overset{H}{\overset{|}{N}}\right)_2H$$

Dispersant additive C:

$R—O—CH_2CH_2CH_2NH_2$ (R stands for a mixture of alkyl groups having 12 to 15 carbon atoms)

Dispersant additive D:

$$R—O\left(CH_2CH_2CH_2\overset{H}{\overset{|}{N}}\right)_2H$$

(R stands for a mixture of alkyl groups having 12 to 15 carbon atoms)

Dispersant additive E:

$$C_{12}H_{25}—O\left(CH_2CH_2CH_2\overset{H}{\overset{|}{N}}\right)_3H$$

Dispersant additive F:

$R'—O—CH_2CH_2CH_2NH_2$ (R' stands for a Guerbet alcohol residue having 32 carbon atoms)

Dispersant additive G:

$R''—O—CH_2CH_2CH_2NH_2$ (R'' stand for a mixture of synthetic alcohol residues having 20 to 30 carbon atoms)

Dispersant additive H:

Calcium petroleum sulfonate

Dispersant additive I:

Sorbitan monooleate

Of the above-mentioned additives, the additives A through G are those of the present invention, and the additives H and I are comparative additives.

TABLE 2

| | Residual Oil | Additive | Concn. (% by weight) of Additive | Evaluation in Spot Ring Test | Dry Sludge Content (% by weight) |
|---|---|---|---|---|---|
| Example No. | | | | | |
| 1 | a | A | 1.0 | 2 | 0.08 |
| 2 | a | B | 0.5 | 2 | 0.06 |
| 3 | a | B | 1.0 | 1 | 0.04 |
| 4 | b | A | 0.5 | 1 | 0.05 |
| 5 | b | B | 0.25 | 2 | 0.06 |
| 6 | b | B | 0.5 | 1 | 0.03 |
| 7 | b | C | 0.25 | 1 | 0.04 |
| 8 | b | C | 0.5 | 1 | 0.03 |
| 9 | b | D | 0.25 | 2 | 0.07 |
| 10 | b | D | 0.5 | 1 | 0.05 |
| 11 | b | E | 0.5 | 1 | 0.04 |
| 12 | b | F | 0.5 | 2 | 0.08 |
| 13 | b | G | 0.5 | 1 | 0.06 |
| Comparative Example No. | | | | | |
| 1 | a | — | — | 5 | 0.5 |
| 2 | a | H | 1.0 | 5 | 0.5 |
| 3 | a | I | 1.0 | 5 | 0.5 |
| 4 | b | — | — | 4 | 0.2 |
| 5 | b | H | 1.0 | 4 | 0.2 |
| 6 | b | I | 1.0 | 4 | 0.2 |

Embodiment (G) and (H)

These were examined in the same way as shown in Embodiments (A) to (E).

Examples 1 to 12

The following dispersant additives were used, and they were added in amounts shown in Table 3.

(Dispersant Additive)

Additive A:

Mixture of dodecyl phosphate and didodecyl phosphate (sesquidodecyl phosphate)

Additive B:

Stearyl phosphate

Additive C:

Distearyl phosphate

Additive D:

Behenyl phosphate

Additive E:

Phosphate of propylene oxide adduct (average molar number of addition=3) of stearyl alcohol Additive F:

Oleylamine salt of sesquidodecyl phosphate

Of the above-mentioned additives, the additives A through F are those of the present invention.

TABLE 3

| | Residual Fuel Oil | Additive | Concn. (% by weight) of Additive | Evaluation in Spot Ring Test | Dry Sludge Content (% by weight) |
|---|---|---|---|---|---|
| Example No. | | | | | |
| 1 | a | A | 1.0 | 2 | 0.09 |
| 2 | a | D | 0.5 | 2 | 0.06 |
| 3 | a | D | 1.0 | 1 | 0.05 |

TABLE 3-continued

| | Residual Fuel Oil | Additive | Concn. (% by weight) of Additive | Evaluation in Spot Ring Test | Dry Sludge Content (% by weight) |
|---|---|---|---|---|---|
| 4 | b | A | 0.5 | 2 | 0.07 |
| 5 | b | B | 0.25 | 2 | 0.08 |
| 6 | b | B | 0.5 | 1 | 0.05 |
| 7 | b | C | 0.25 | 2 | 0.06 |
| 8 | b | C | 0.5 | 1 | 0.04 |
| 9 | b | D | 0.25 | 2 | 0.08 |
| 10 | b | D | 0.5 | 1 | 0.04 |
| 11 | b | E | 1.0 | 1 | 0.04 |
| 12 | b | F | 0.5 | 2 | 0.06 |

Embodiment (I) and (J)

Examples 1 to 12 and Comparative Examples 1 to 6

These were also examined in the same way as shown in Embodiment (A) to (E). The dispersant used are listed below. Compositions and results are shown in Table 4.

Additive A: didodecyl dithiophosphate
Additive B: distearyl dithiophosphate
Additive C: dibehenyl dithiophosphate
Additive D: ester of dithiophosphoric acid and propylene oxide adduct of stearyl alcohol (average addition: 5 moles)
Additive E: zinc salt of distearyl dithiophosphate
Additive F: calcium petroleum sulfonate
Additive G: sorbitane monooleate Among the above additives, A to E are the additives of the invention and F and G are conventional additives.

TABLE 4

| | Residual fuel oil | Additive | Concentration of additive (% by weight) | Spot ring evaluation | Amount of dry sludge (% by weight) |
|---|---|---|---|---|---|
| Example | | | | | |
| 1 | a | A | 1.0 | 2 | 0.08 |
| 2 | a | B | 0.5 | 2 | 0.09 |
| 3 | a | B | 1.0 | 2 | 0.06 |
| 4 | b | A | 0.5 | 2 | 0.08 |
| 5 | b | B | 0.25 | 2 | 0.08 |
| 6 | b | B | 0.5 | 1 | 0.06 |
| 7 | b | C | 0.25 | 1 | 0.05 |
| 8 | b | C | 0.5 | 1 | 0.04 |
| 9 | b | D | 0.25 | 2 | 0.09 |
| 10 | b | D | 0.5 | 2 | 0.08 |
| 11 | b | E | 0.25 | 1 | 0.05 |
| 12 | b | E | 0.5 | 1 | 0.05 |
| Comparative example | | | | | |
| 1 | a | — | — | 5 | 0.5 |
| 2 | a | F | 1.0 | 5 | 0.5 |
| 3 | a | G | 1.0 | 5 | 0.5 |
| 4 | b | — | — | 4 | 0.2 |
| 5 | b | F | 1.0 | 4 | 0.2 |
| 6 | b | G | 1.0 | 4 | 0.2 |

The embodiments of the invention in which an exclusive property or privilege is claimed are defined as follows:

1. A residual fuel oil which comprises (1) 15 to 79.95 wt. % of a thermal cracking oil, (2) 20 to 80 wt. % of a diluent selected from cracked cycle oil, kerosene or gas oil and (3) 0.05 to 5 wt. % of a dispersant selected from the group consisting of (A), (B), (C), (D), (E), (F), (G), (H), (I), and (J), in which:

(A) has the formula (A-1):

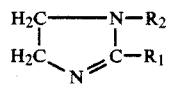

(A-1)

wherein $R_1$ is a hydrocarbon group having 7 to 23 carbon atoms, and $R_2$ is a hydrogen atom or a hydrocarbon group having 1 to 22 carbon atoms;

(B) has the formula (B-1) or (b-2):

$$R_1CONH(CH_2)_2NHR_2 \quad \text{(B-1)}$$

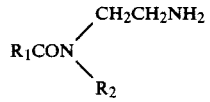

(B-2)

wherein $R_1$ is a hydrocarbon group having 7 to 23 carbon atoms, and $R_2$ is a hydrogen atom of a substituent selected from the group consisting of a hydrocarbon group having 1 to 22 carbon atoms and an aminoalkyl, an acylaminoalkyl or a hydroxyalkyl group having 2 to 44 carbon atoms;

(C) has the formula (C-1), (C-2) or (C-3):

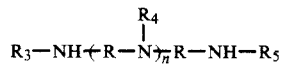

(C-1)

-continued

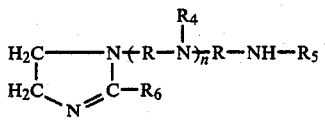

(C-2)

wherein $R_3$ and $R_4$ are each a hydrogen atom or an acyl group having 8 to 22 carbon atoms, $R_5$ is an acyl group having 8 to 22 carbon atoms, $R_6$ is a hydrocarbon group having 7 to 23 carbon atoms, R is an alkylene group having 2 to 4 carbon atoms, and n is an integer of from 1 to 4;

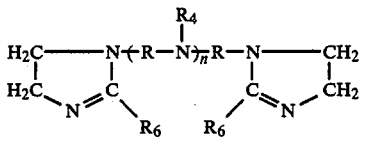

(C-3)

wherein $R_4$ is a hydrogen atom, $R_6$ is a hydrocarbon group having 7 to 23 carbon atoms, R is an alkylene group having 2 to 4 carbon atoms, and n is an integer of from 1 to 4;

(D) and (E) having the formulae (D-1) and (E-1), respectively:

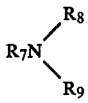

(D-1)

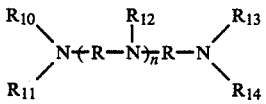

(E-1)

wherein $R_7$ is a hydrocarbon group having 9 to 22 carbon atoms, $R_8$ and $R_9$ are each a hydrogen atom or a hydrocarbon group having 8 to 22 carbon atoms, $R_{10'}$, $R_{11'}$, $R_{12'}$, $R_{13}$ and $R_{14}$ are each a hydrogen atom or a hydrocarbon group having 8 to 22 carbon atoms with the proviso that at least one of $R_{10}$ through $R_{14}$ comprises an alkylene group, R is an alkylene group having 2 to 4 carbon atoms, and n is 0 or an integer of 1 to 9;

(F) has the formula (F-1):

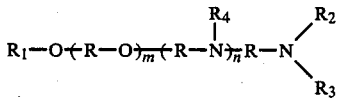

(F-1)

wherein $R_1$ is a hydrocarbon group having 12 to 36 carbon atoms, $R_2$ and $R_3$ are each a hydrogen atom, $R_4$ is a hydrogen atom or a hydrocarbon group having 8 to 22 carbon atoms, R is an alkylene group having 2 to 4 carbon atoms, n is 0 or an integer of 1 to 9, and m is an integer of 1 to 15;

(G) has the formula (G-1):

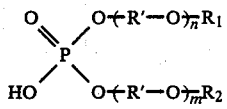

(G-1)

wherein $R_1$ is a hydrogen atom or a hydrocarbon group having 8 to 30 carbon atoms, $R_2$ is a hydrogen atom or a hydrocarbon group having 8 to 30 carbon atoms, R' is an alkylene group having 2 to 4 carbon atoms, and n and m are each 0 or an integer of 1 to 15, with the proviso that both $R_1$ and $R_2$ are not simultaneously a hydrogen atom;

(H) is a salt of (G), wherein the salt is selected from the group consisting of an alkali metal salt, an alkaline earth metal salt, an amine salt and a zinc salt;

(I) has the formula (I-1);

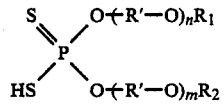

(I-1)

wherein $R_1$ is a hydrogen atom or a hydrocarbon group having 8 to 30 carbon atoms, $R_2$ is a hydrogen atom or a hydrocarbon group having 8 to 30 carbon atoms, R' is an alkylene having 2 to 4 carbon atoms and n and m each are zero or an integer of 1 to 15, with the proviso that both $R_1$ and $R_2$ are not simultaneously a hydrogen atom; and (J) is a salt of (I), wherein the salt is selected from the group consisting of an alkali metal salt, an alkaline earth metal salt, an amine salt and a zinc salt.

2. A residual fuel oil of claim 1, in which said dispersant (3) is selected from the group consisting of (A), (B), (C), (D) and (E).

3. A residual fuel oil of claim 1, in which said dispersant (3) is (A).

4. A residual fuel oil of claim 1, in which said dispersant (3) is (B).

5. A residual fuel oil of claim 4, in which (B) has the formula (B-1).

6. A residual fuel oil of claim 4, in which (B) has the formula (B-2).

7. A residual fuel oil of claim 1, in which said dispersant (3) is (C).

8. A residual fuel oil of claim 7, in which (C) has the formula (C-1).

9. A residual fuel oil of claim 7, in which (C) has the formula (C-2).

10. A residual fuel oil of claim 7, in which (C) has the formula (C-3).

11. A residual fuel oil of claim 1, in which said dispersant (3) is (D).

12. A residual fuel oil of claim 1, in which said dispersant (3) is (E).

13. A residual fuel oil of claim 1, in which said dispersant (3) is (F).

14. A residual fuel oil of claim 1, in which said dispersant (3) is (G).

15. A residual fuel oil of claim 1, in which said dispersant (3) is (H).

16. A residual fuel oil of claim 1, in which said dispersant (3) is (I).

17. A residual fuel oil of claim 1, in which said dispersant (3) is (J).

18. A residual fuel oil of claim 1, in which said dispersant is present in an amount of 0.1 to 5.0 wt. %.

19. A residual fuel oil of claim 1, in which said dispersant is present in an amount of 0.25 to 0.5 wt. %.

* * * * *